US006835437B2

(12) United States Patent
Goers et al.

(10) Patent No.: US 6,835,437 B2
(45) Date of Patent: Dec. 28, 2004

(54) FOLDED EXPAND-ON-SITE PAPER PACKAGING

(75) Inventors: John L. Goers, Castle Rock, CO (US); William H. Oliver, Denver, CO (US)

(73) Assignee: FoldedPak LLC, Greenwood Village, CO (US)

( * ) Notice: Subject to any disclaimer, the term of this patent is extended or adjusted under 35 U.S.C. 154(b) by 0 days.

(21) Appl. No.: 09/726,371

(22) Filed: Nov. 29, 2000

(65) Prior Publication Data

US 2002/0064625 A1 May 30, 2002

(51) Int. Cl.[7] ..... B32B 3/10; B32B 3/28; B32B 3/30; B65D 45/28; B65D 81/02; B65D 85/30; D02G 3/00

(52) U.S. Cl. ..... 428/131; 428/43; 428/182; 428/397; 428/400; 206/584; 206/585; 206/814

(58) Field of Search ..... 428/43, 369, 156, 428/116, 172, 182, 153, 154, 167, 184, 371, 397, 400, 537.5; 206/584, 585, 814; 493/967

(56) References Cited

U.S. PATENT DOCUMENTS 5,213,867 A * 5/1993 Huston et al. ..... 428/126
5,339,958 A 8/1994 Taravella et al. ..... 206/521
5,439,730 A * 8/1995 Kelly et al. ..... 206/584
5,468,525 A * 11/1995 Watts ..... 206/521
5,468,556 A * 11/1995 Fuss et al. ..... 206/584
5,569,519 A * 10/1996 Ervay et al. ..... 206/523
5,643,647 A * 7/1997 Wischusen, III ..... 206/584
5,698,293 A * 12/1997 Nordlund et al. ..... 206/584
5,712,020 A * 1/1998 Parker ..... 428/152
6,132,842 A * 10/2000 Simmons et al. ..... 138/166

* cited by examiner

*Primary Examiner*—Harold Pyon
*Assistant Examiner*—Patricia L. Nordmeyer
(74) *Attorney, Agent, or Firm*—Merchant & Gould P.C.

(57) ABSTRACT

A series of interconnected packing chip precursors that can be formed and transported economically to a packager as a flat sheet and then expanded at the site where they will be used into individual packing chips by folding and separation from the other chips. Preferably, the precursors are formed on a chipboard sheet by forming fold lines and lines of separation and by adding securing means, such as bonding media or connecting features to secure the sides of the expanded packing chip in its final shape. The fold lines and lines of separation can be configured to form jagged or serrated edges on the expand-on-site packing chip, and the chip may also include apertures; the jagged and serrated edges and the apertures cooperating with each other and other aspects of adjacent chips to interlock the chips when they are placed around an item in a package for shipment.

38 Claims, 6 Drawing Sheets

THE COMPLETED PACKAGING PRODUCT 50

THE COMPLETED PACKAGING PRODUCT 50

END VIEW, LAP JOINT

END VIEW, BUTTED TAB JOINT

CIRCULAR PACKING CHIP

CIRCULAR PACKING CHIP INTERMEDIATE
(BUTTED TAB JOINT STYLE)

FOLDED EXPAND-ON-SITE PAPER PACKAGING

I. FIELD OF THE INVENTION

The present invention relates generally to loose fill packing materials or "dunnage," as these materials are sometimes referred to. Traditionally these materials have often been supplied in the form of pre-expanded packing "chips," such as plastic "peanuts." More specifically, the invention relates to: (1) compact sheets of chip precursors which can be shipped and stored more economically and (2) packing chips which can be formed by folding or expanding the chip precursors at the place where the packing chips will be used.

II. BACKGROUND OF THE INVENTION

Experience indicates that a packing material must have a number of important attributes including:

1. Cushioning Properties:

The packaging material must provide cushioning for packaged items to protect them during shipment. The cushioning must dissipate or diffuse the shock loads imposed on the packaging container (typically a "box") during shipment so that those loads are not applied to the packaged item directly. It is also important that the packaging material have high rebound characteristics (within its usable range) so that it can continue to provide cushioning, as loads are repeatedly applied. Different items packed for shipment may require different degrees of stiffness to adequately protect them.

2. Blocking and Bracing Properties:

The ability of the packaging material to "block and brace" refers to its capability to prevent movement of the packaged item within the container so that the packaging can cushion that item. If a packed item is allowed to move against the wall of the container, with no cushioning in between, then it will be directly subjected to any shock loads applied to the outside of the box adjacent that location.

3. Ease of Use:

The packing material must be easy to use in order to minimize the labor required to pack an item. In particular, the packing material should be capable of being easily and quickly positioned around the packed item.

4. Storage of packaging materials:

The physical form that a packaging material is stored in is an important attribute. Packaging materials generally fall into two categories:

a) "Pre-expanded" materials—like plastic peanuts or bubble sheets—are supplied by the manufacturer to the packager in final form.

b) "Expand-on-site" materials are supplied to the packager in a dense, un-expanded condition. The packaging is expanded into its final form at the packager's site. Prior art systems have utilized inflation, or wadding and crumpling to produce expanded packaging from flat materials. The formation of foam packaging on site may also be included in this category of expand-on-site materials. Expansion ratios vary from about 10:1 for wadded Kraft paper cushioning to as much as 50:1 for expanding foams. Expand-on-site materials enjoy a large advantage, since they do not occupy highly valued inventory space at the packager's facility and have much lower costs for shipping to the packager.

5. Economics:

The packaging material must be competitive in price with other materials that provide the same level of protection. Labor and shipping charges (to get the material to the packager) can be a significant percentage of the total cost-of packaging products. Pre-expanded materials necessarily entail higher shipping charges than expand-on-site materials whose useful volume is created at the packager.

6. Creation of Dust:

The packaging material must not create dust or other debris that will stick to the packaged item and make it unsightly for the recipient. This is a particular problem with uncompressed materials molded from a cellulose slurry that have rough surfaces and edges from which small particles will be separated in the course of normal handling and use.

7. Density:

The packaging material must be as lightweight as possible to minimize shipping charges for the packaged item. Generally, these shipping charges are based on the weight of the package and its contents.

8. Environmental Friendliness:

Packaging materials made from plastics or toxic, two-part, expanding foams have a disadvantage in the marketplace as compared to paper-based products, because they do not quickly biodegrade in the same environmentally friendly way that paper based products do. In addition, recipients of packaged items generally prefer paper-based packaging due to the negative environmental image of plastic based materials.

9. "Flowability" and Associated Side-effects:

Flowable packaging materials, such as plastic "peanuts," are in wide use today, because they substantially reduce labor costs associated with packing. Highly "flowable" packaging materials may be poured and placed into a shipping container quickly. They also do not require wrapping, taping or other labor-intensive operations as with many other packing materials. However, flowables (i.e., loose format packaging materials) have not provided adequate blocking and bracing characteristics. Plastic peanuts, for example, exhibit good cushioning properties, but have such poor blocking and bracing characteristics that the packaged item moves around in the container or box. When the packaged item reaches a wall of the container, it is no longer protected by the packaging material and is susceptible to being broken when the package receives an external blow. By definition, "flowables" flow easily into the box during packing, but also flow inside the box after packing, allowing movement of the packaged item. The exception to this are E-Cubes® packing chips, which are described in U.S. Pat. No. 5,900,119. E-Cubes® packing chips were the first flowable packaging material that had good blocking and bracing properties. This was accomplished with a combination of shape and texture which permits interlocking of the chips after they are placed around a packaged item.

No packing material commercially utilized to date has satisfied all of these characteristics. In summary, the ideal packaging product would:

1. Be a flowable to make packing fast and economical;
2. Have good cushioning and blocking and bracing properties;
3. Be an expand-on-site type material using simple reliable machinery;
4. Be made from recycled paper and be recyclable to protect the environment;
5. Minimize the costs of shipping both to the packager and the recipient of a packaged item; and
6. Be clean so that dust or other debris are not generated during use and are not transferred to the item being shipped.

III. SUMMARY OF THE INVENTION

A new packaging material has been invented that has all of these characteristics. The packaging is a flowable and is made from a material commonly known as "chipboard." Chipboard is produced by paper mills worldwide and is usually comprised of 100% recycled content. The chipboard is modified into an expand-on-site packaging material by adding fold lines, cutouts, perforations and/or perforation lines to the flat chipboard. Binding media, e.g., an adhesive, may also be pre-applied to appropriate portions of the expand-on-site material. The modified chipboard can be stacked, rolled or fan-folded for shipment to the packager. This significantly reduces transportation costs and customer inventory space/cost requirements.

When the packager wishes to use the expand-on-site material, it removes the appropriate quantity of chip precursors from inventory, folds or expands the precursors into the shape of the packaging material and secures it in that shape. These steps can be performed manually or by machine. In either method appropriate portions of the expand-on-site precursor material are separated from the other intermediates and are formed it into the final shape of the packaging material. Adhesive on mating sections of each chip is activated to hold the material in its final shape. The assembly may be done at or near the actual packaging station where the packaging material will be placed around an item to be shipped in its shipping container. The chips could also be supplied to the packager pre-expanded and ready for use.

The invention described herein relates to an improved, expand-on-site packaging material in its intermediate (i.e., precursor) and final (i.e., expanded) forms and the methods of making both the expand-on-site and expanded materials.

IV. BRIEF DESCRIPTION OF THE DRAWINGS

Figure 5B:
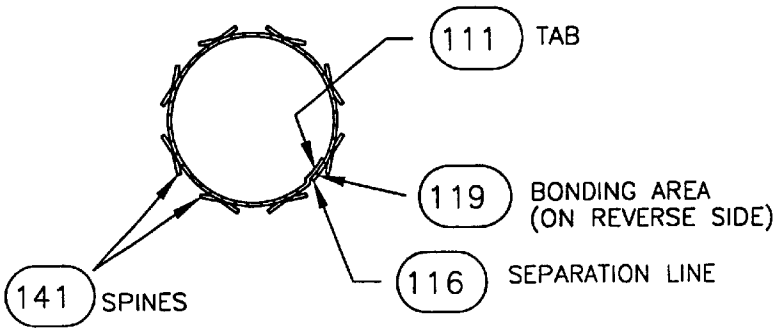
Figure 5A:
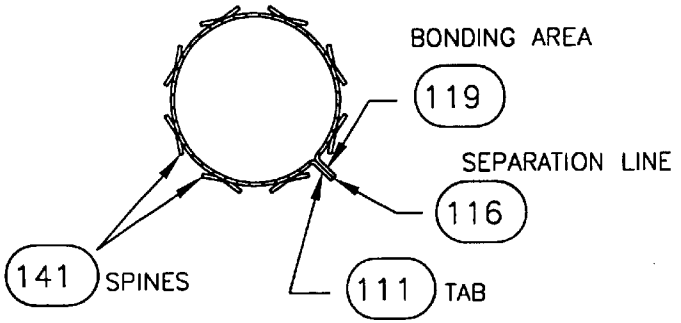
Figure 5:
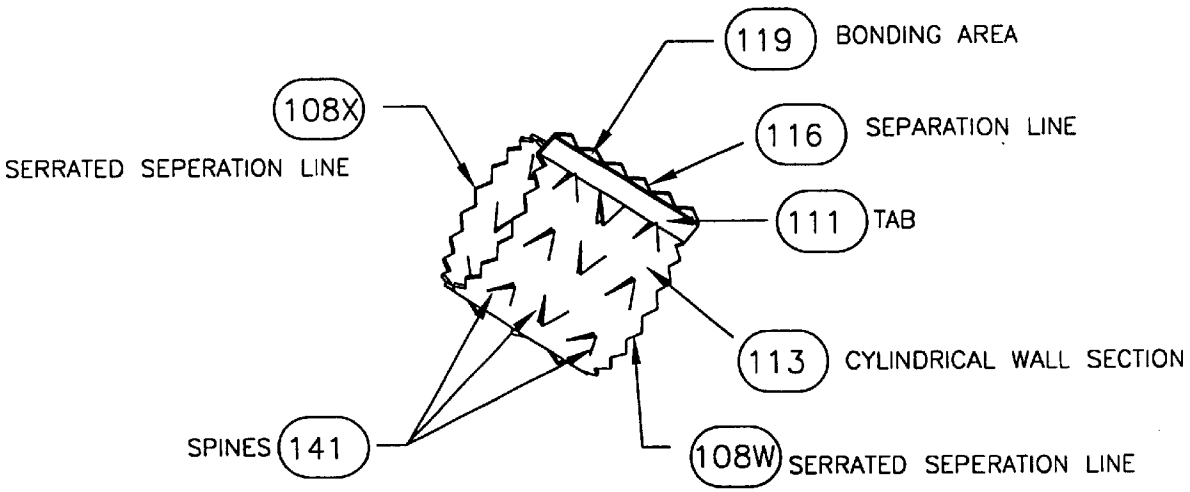

FIG. 5 is a perspective view of another embodiment of the present invention in which the completed packing material has a circular cross-section. FIGS. 5A and 5B show end views of the same packing chip. In FIGS. 5 and 5A, the chip is secured with a butt joint. In FIG. 5B, the chip is secured with a lap joint.

Figure 6:
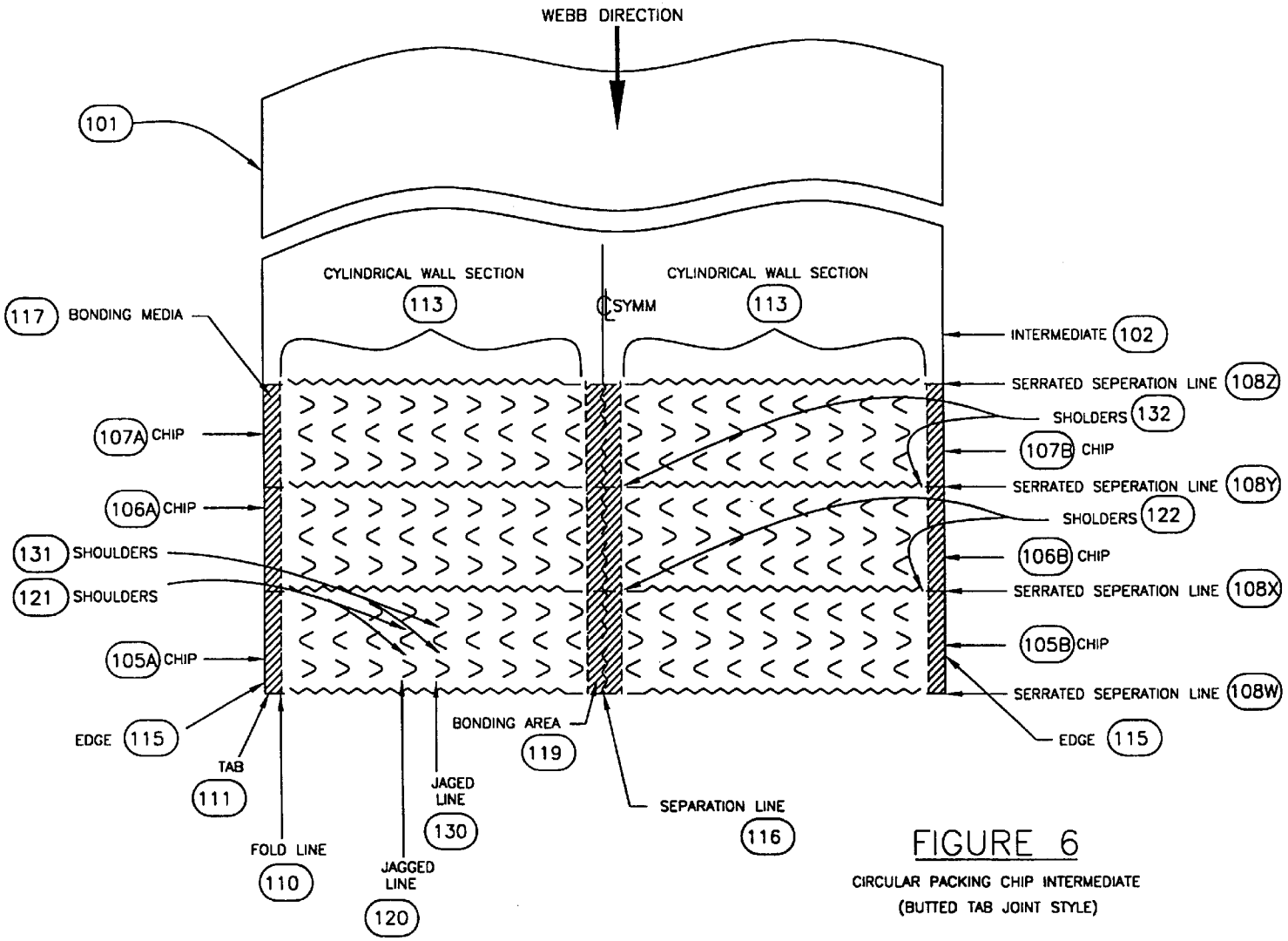

FIG. 6 illustrates a preferred configuration of the intermediate from which the circular packing chip of FIG. 5 is prepared.

V. DETAILED DESCRIPTION OF THE INVENTION AND THE PREFERRED EMBODIMENT

Among other things, the present invention includes a packing chip formed from a flat intermediate sheet containing two or more chip precursors, where the chip comprises: sides configured so that the packing chip has a cross-section selected from the group consisting of a triangle, circle or polygon, and securing means for securing the sides of the chip in its final shape.

The invention also includes an intermediate sheet of two or more packing chip precursors capable of being formed into expanded packing chips, each chip precursor being separably connected to at least one adjacent chip precursor and comprising: one or more sections each of which is foldably attached to at least one other section which upon folding form the sides of the expanded packing chip; and securing means selected from the group consisting of bonding media or connecting features for securing the sides of the expanded packing chip in its expanded shape. Further, the invention includes a method for forming an intermediate sheet of two or more packing chip precursors comprising: forming lines of separation to separably connect each chip to the adjacent chips on said intermediate sheet; forming at least three sections on each chip by creating fold lines between said sections, and adding one or more securing means selected from the group consisting of bonding media and connecting features to secure the sides in their final form when expanded.

Figure 1:
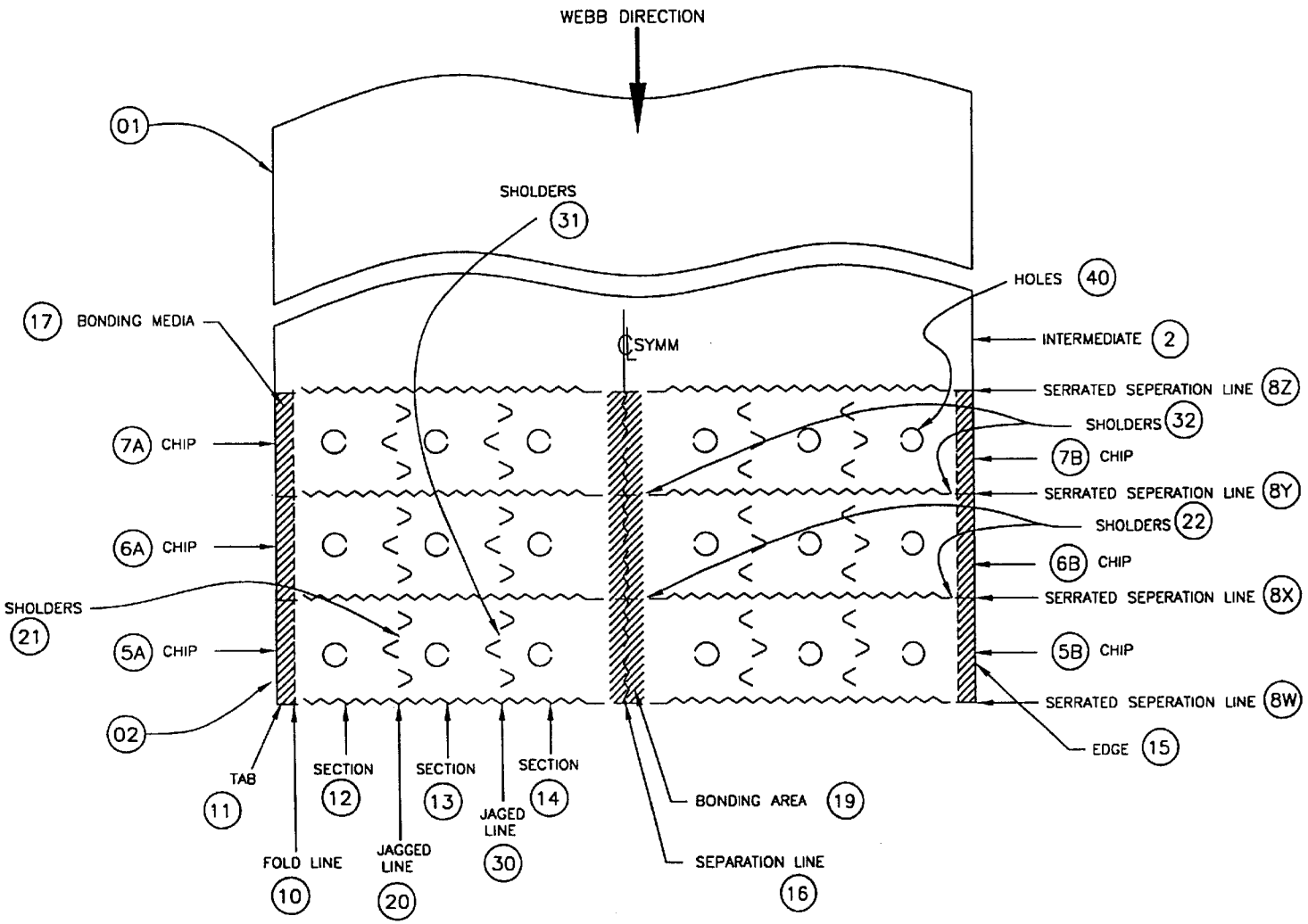
FIG. 1 is an illustration of a preferred intermediate sheet containing packing chip precursors in a form suitable for delivery to a packager.
Figure 2:
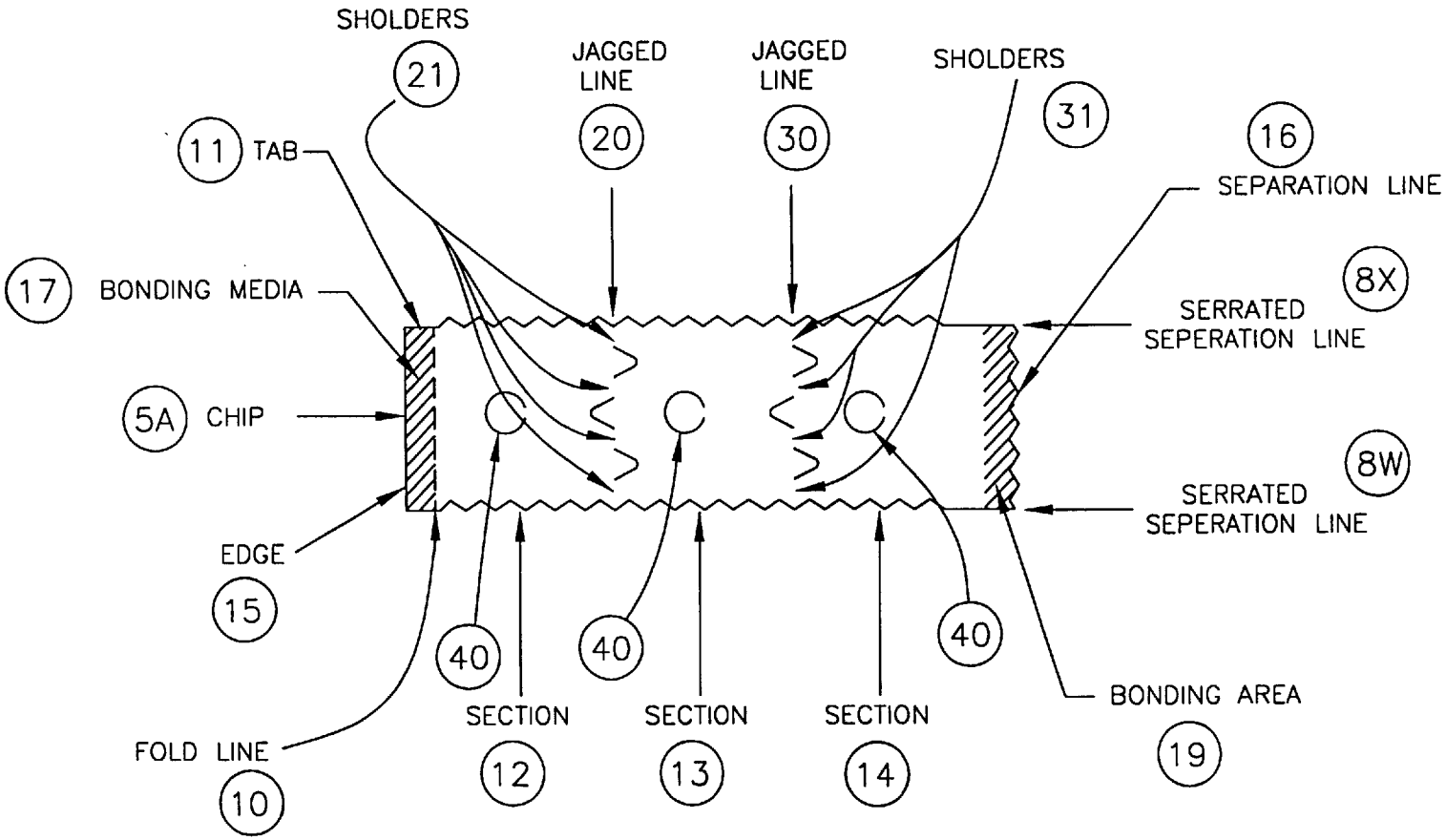
FIG. 2 is an illustration of the features of a single chip precursor on the intermediate sheet depicted in FIG. 1.
Figure 3:
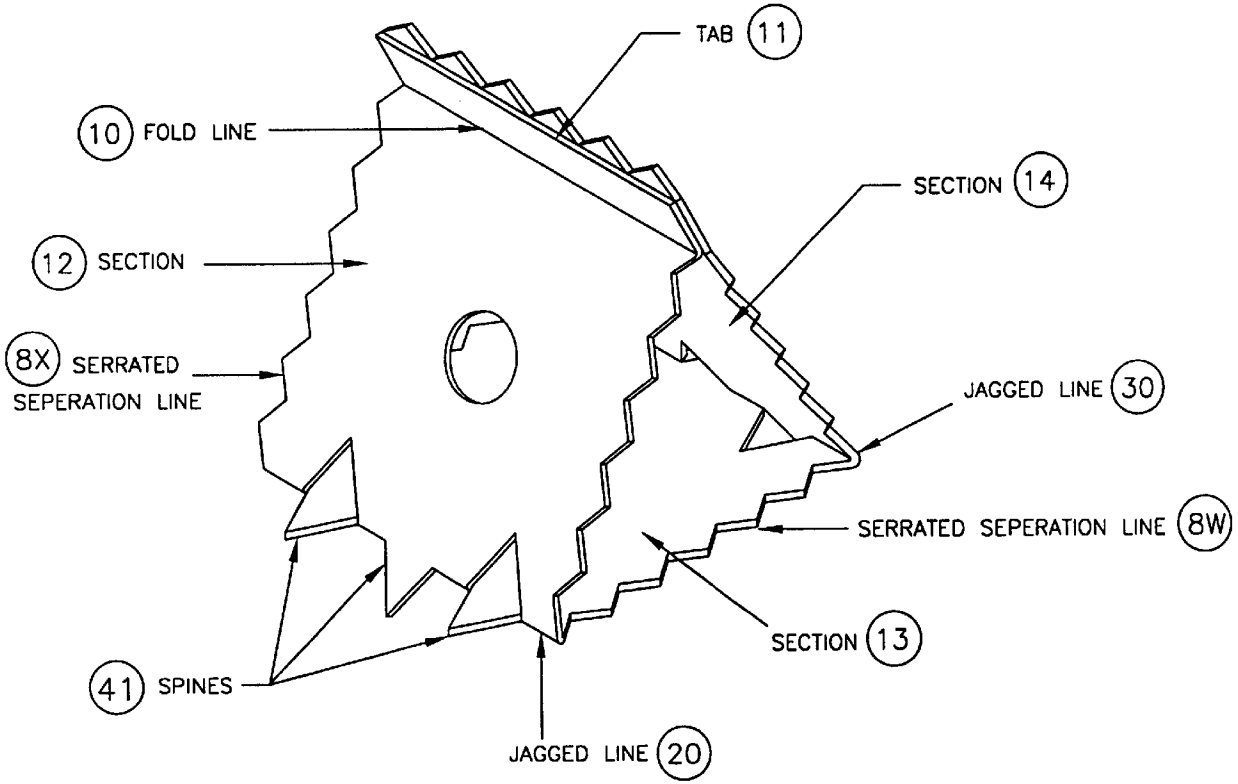
FIG. 3 is an illustration of the completed packaging material, i.e., as expanded by the packager from the intermediate shown in FIG. 1. The chip illustrated in FIG. 3 has a preferred cross-section in the form of a triangle.

Finally, the invention comprises a method for forming an expand-on-site packing chip from an intermediate sheet containing two or more chip precursors comprising: folding the precursor into at least three sections to form the sides of the expanded packing chip; attaching the sides of the expanded packing chip; and separating the expanded chip from the adjacent chip or chips The invention can best be understood by reference to FIGS. 1 and 2 illustrating an expand-on-site intermediate material made from chipboard and FIG. 3 illustrating the packing chip produced from the intermediate in its expanded form.

As noted previously "chipboard" is made by a number of paper manufactures, for example, Republic Paperboard Company, Hutchinson, Kans. Chipboard is a thin smooth-finished, material made from recycled paper and typically provided in the form of a continuous roll. Chipboard generally connotes a low grade of stiff paper or cardboard and is frequently used as a backing for pads of paper, a stiffener for the mailing or framing of photographs and for other similar uses. However, to the best of applicants' knowledge "chipboard" has not previously been employed to form packing chips, and its name should not be construed to suggest a prior association of that material with this use. Applicants have now found that chipboard is a good starting material to produce packing chips, because of its low cost, strength and stiffness. Specific materials employed to date include Republic Paperboard's "24-point core standard," "20-point tan bending stock" and "18 point brown bending chipboard." Other thicknesses and types of chipboard and other materials meeting these requirements might be used, such as, Kraft paper. Synthetic or plastic materials might also be used, especially where waterproof, fireproof or chemically resistant packaging is required.

FIG. 1 illustrates one preferred embodiment of the invention in which continuous chipboard sheet 1 is processed into continuous sheet 2 of expand-on-site chip intermediates or precursors. As illustrated in FIG. 1, sheet 2 comprises two rows of such chips—one row comprising chips 5A, 6A and 7A, which are abutted by an adjacent row of chips 5B, 6B and 7B. However, depending on the width of the chipboard 1, a single row of such chips or any number of adjacent rows of chips can be formed side-by-side on sheet 2. Regardless of the number of rows, it is preferred that the chip precursors formed on the sheet of chipboard all remain attached to one another until expanded and separated by the packager.

Typically, chipboard sheet 1 is provided from the mill in rolled or fan-folded form. The sheet is unrolled and processed continuously by an intermediate "converter" which has stations to make perforations or lines of weakness for folding or separation, as necessary, and for making holes or other apertures in the chip precursors. In addition, the converter may add bonding media, such as adhesive, or connecting features at appropriate places. The sequence in which these steps are performed may be varied depending on the design of the chip precursors and their arrangement on sheet 2. It is anticipated that machines normally employed in the manufacturer of forms or mailers, as well as machines used to make beverage cartons, can be used in the production of intermediate sheet 2 as described herein. All or part of the steps performed by the converter may be performed at the site where the chipboard is made and/or at the site of an intermediate manufacturer. They might also be performed at the site of the ultimate packager, if the volume of chips employed by the packager justifies the capital expense. In the preferred embodiment described herein, all of the structural features of the intermediate are preformed, and the intermediate is delivered to the packager ready for final expansion and separation into individual packaging chips.

In the preferred embodiment shown in FIG. 2, chip 5A comprises sections, 12, 13 and 14, which are bounded by jagged fold lines 20 and 30. Fold line 20, for example, is made by the converter with sufficient penetration of the chipboard to facilitate folding and partial separation of sections 12 and 13 during expansion by the expanding machine except at common shoulders 21, where the two adjacent sections are folded but remain attached. (See FIG. 3) Similarly, fold line 30 enables eventual partial separation of sections 13 and 14, except at shoulders 31. (See FIG. 3) In addition, a fold line 10 is formed on one portion of section 12 to form a tab 11 between edge 15 and section 12. Bonding media 17 can be applied to the tab 11 and/or to the mating bonding area 19 for securing the expanded chip in its final shape, shown in FIG. 3.

As shown in FIG. 1, the converter adds a perforation line 8X between chips 5 (A, B) and 6 (A, B) to enable them to be completely separated from one another prior to, during or after the expansion step, as necessary. The separation between chips 5B and 6B is accomplished, for example, by bursting shoulders 22. A similar line 8W may be added to the front of chips 5A and 5B, which as shown are the leading chips on the sheet 2. Similarly, a perforation line 8Y is formed between chips 6 (A, B) and 7 (A, B). Again, the separation between chips 6B and 7B can be accomplished by bursting shoulders 32. As illustrated in the drawing, lines 8W, 8X, 8Y and 8Z are zigzag in configuration, so that the edges formed on the separated and expanded chips will be jagged or serrated, thereby providing appropriate irregular surfaces for interlocking with other fully expanded chips when used as packaging. The lines 8W, 8X, 8Y and 8Z could be formed in other configurations that would accomplish the same result.

Similarly, the intermediate converter forms a line of weakness 16 between the chips in row A (i.e., chips 5A, 6A and 7A) and the chips in row B (i.e., chips 5B, 6B and 7B). The chips in each row may be separated from the adjacent chip in the other by bursting line of weakness 16. Again, line 16 has a zigzag configuration, so that this edge of each chip after separation will be jagged or serrated to aid in interlocking of the expanded chips.

The intermediate converter also adds apertures, such as holes 40, at various locations on each chip precursor. Usually, it is desirable to both cut the aperture and to remove the center portion of the aperture before shipment of the intermediate to the packager. This reduces the shipping weight of intermediate 2. Alternatively, the holes 40 can be preformed by the converter, and the center portion removed or just folded in during expansion-on-site. The apertures or holes 40 shown in the drawings are circular, but can be any shape, e.g., triangular, square or star shaped in configuration. There may be multiple holes in each section to decrease weight and increase interlocking of the chips. As described later, the holes interlock with jagged or serrated portions on adjacent chips after the chips are applied around a packaged item to be shipped, thereby providing improved blocking, bracing and cushioning characteristics during shipment.

The bonding media 17 may be a polymer or any suitable adhesive such as thermosetting, microwave-activated, ultrasonic-activated, wettable or pressure activated types that are suitable depending upon the conditions of storage and use. The adhesive can be applied directly to the intermediate 2 or supplied in the form of a transfer tape. The adhesive should be selected and/or located so that adjacent segments of intermediate 2 will not bond to one another causing "bricking" after the sheet 2 is rolled or fan-folded for shipment to the packager. Technologies for doing this are well known to those skilled, for example, in the art of manufacturing mailers and forms with adhesives applied to various portions. At the present time it is anticipated that "hot melt," i.e., thermosetting, adhesives are preferable, because they are relatively easy to activate when desired, do not result in bricking of the intermediate when rolled or folded on itself under normal conditions of use, and form a secure bond after curing to maintain the structure of the expanded packing chip.

Although the bonding media is shown in FIG. 1 as being located on the entire portion of tab 11 and on mating area 19, the adhesive could be located on only a portion of those areas either in a continuous line or in spots in order that the objectives mentioned previously are met while minimizing cost.

If a plastic or other synthetic material is used instead of chipboard, adhesive need not be employed. Instead, bonding of the fully expanded chips can be accomplished by the application of pressure and/or heat, ultrasonic energy, solvent, or microwave energy during the assembly of the chips.

As an alternative to bonding media, the converter may add features to tab 11 and area 19 to form connecting features to mechanically hold the fully expanded chip in shape. These connecting features may include; dovetail slots and grooves, tongue and groove cuts, hook cuts and combinations thereof. These features are "snapped" together to secure the sections of the chips and thereby maintain the chips in their expanded form. Alternatively, attachment methods, such as crimping, stapling, etc., can be utilized after expansion of the precursor to hold the chip in its final shape.

As used herein "securing means" collectively refers to bonding media, connecting features and attachment methods.

After preparation by the converter, intermediate sheet 2 of chips 5 (A, B), 6 (A, B) and 7 (A, B), etc. may be rolled, stacked or fan-folded and transported to the packager where it is stored in that format until it is ready to be used.

When the packager needs packaging material, it unrolls or unfolds the sheet 2 and either manually expands the precursors into finished chips or threads the sheet into the expanding machine to form individual packing chips 50 as illustrated in FIG. 3. This can be accomplished in various ways. In a preferred method, the machine folds along lines 10, 20, and 30 to form the tab 11 and to form sides 12, 13 and 14 into a triangular shape. The folding of lines 20 and 30 forms spines or projections 41 which are also useful for engagement and interlocking of the chips when used in packaging. The spines 41 are formed by partially cutting out the material on bending comers 20 and 30 of the triangular shaped chip, so that it does not bend but protrudes from the section when the chip is expanded by folding. Heat is applied to activate the hot melt adhesive 17 on tab 1 1 and/or on bonding surface 19, depicted in FIG. 1. Tab 11 is then pressed against the edge portion 16 of section 14 and clamped during cooling to cure the adhesive bond.

Figure 4:
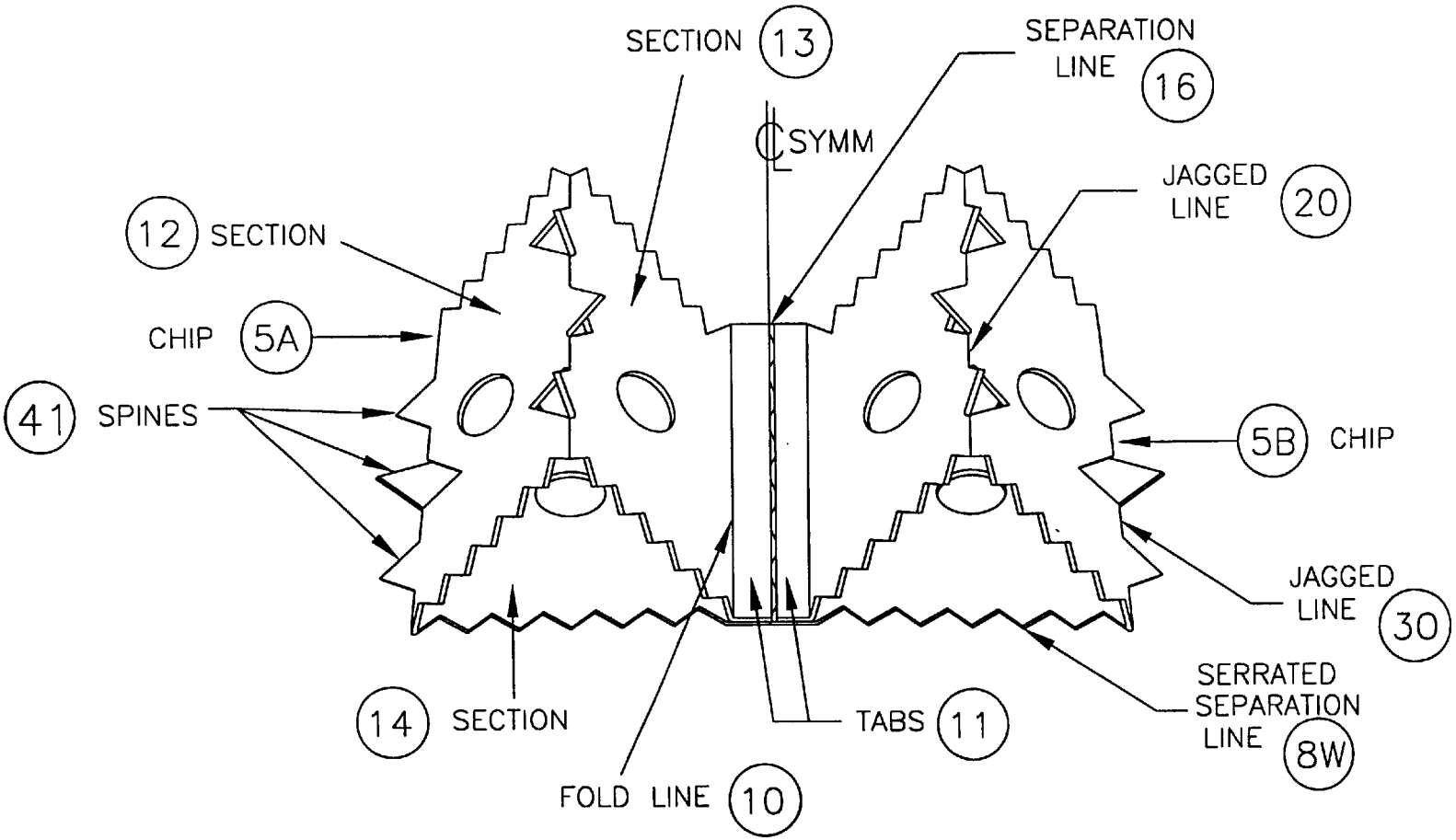
FIG. 4 illustrates the configuration of a double row of chips from the intermediate in FIG. 1 in the process of being transformed into several chips of the type shown in FIG. 3.

In a preferred embodiment of the invention, the assembly of chip 5A occurs simultaneously with the assembly of chip 5B as they remain attached together. FIG. 4 shows these chips 5A and 5B fully formed (i.e., expanded) and bonded. A "bursting" wheel is then used to "burst" chips 5 (A, B) from chips 6 (A, B) along line 8X depicted in FIG. 1. However, chips 5A and 5B remain attached to each other along the separation line 16. Another rotary slitter or bursting wheel is then used for final separation of the chips 5A and 5B from each other. The fully expanded and bonded chip 50 shown in FIG. 3 can then be used as packing material.

The cushioning performance of this expand-on-site packaging is attributable, in part, to its shape and the properties of the material from which it is made. Performance of the completed packing product 50 is enhanced by engagement of the holes 40, serrated edges 8W, 8X, and 16 and spines 41 interacting with one another to lock and prevent slippage of the chips relative to one another. This interlocking of the chips also prevents movement of the packaged item within the container.

The blocking and bracing performance of this expand-on-site packaging can be attributed in part to the interlocking apertures and serrated or jagged edges. If the individual chips had smooth edges, they would readily slide on one another and would not lock with one another and around a packaged item. The surface of commercially available chipboard is relatively smooth and does not create sufficient friction between chips. Simply roughing up the surface would result in exposed paper fibers that would cause dust. Instead, the expand-on-site packaging material has interlocking features (spines, holes and serrated edges) preformed into the surface of each chip. For example, the spines 41 interlock with the serrations, holes, and edges of adjacent chips. The spacing and frequency of these features may be designed to maximize both the likelihood of interlocking adjacent chips and the durability of that interlocking relationship. The combination of these features creates a chip that has excellent blocking and bracing characteristics.

When prepared from chipboard 0.24 inches thick, the expand-on-site packaging material as illustrated in FIG. 3 weighs an average of 1.8 pounds per cubic foot. This is lighter than many competitive products and is considered marketable. Heavy-duty expand-on-site packaging material may also be produced by using heavier caliper (i.e., thicker) chipboard for shipment of higher density packaged items.

As a flowable, the chips will take random orientations in the shipping container. Accordingly, it is desirable for the cushioning properties of this packaging material to be as equal as possible in all axes. A triangular cross section is preferred because of its inherent structural rigidity, allowing the crushing strength of the triangular cross section, i.e., cushioning to be as close as possible to the column strength of the chipboard in a perpendicular axis to the cross-section. Other configurations for the chips may be employed, e.g., circular and polygon cross-sections, but these chips are not as strong as triangular cross-sections.

For example, in FIG. 5, another embodiment of the invention is illustrated in which the packing chip of this invention has a circular cross section. Preferably, the chip is preformed along with other similar chips on a flat segment of chipboard as illustrated, for example in FIG. 6. FIG. 6 shows that a continuous chipboard sheet 101 is processed into continuous sheet 102 of expand-on-site chip intermediates. As illustrated in FIG. 6, sheet 102 comprises two rows of such chips: one row comprising chips 105A, 106A and 107A, which are abutted by an adjacent row of chips 105B, 106B and 107B. Again, depending on the width of the chipboard 101, a single row of such chips or any number of adjacent rows of chips can be formed side-by-side on sheet 102. Regardless of the number of rows, it is preferred that the chips formed on the roll of chipboard all remain attached to one another until expanded and separated by the packager.

Chipboard sheet 101 is unrolled and processed continuously by an intermediate "converter" which has stations to make perforations or lines of weakness for folding or separation as necessary and for making holes or other apertures in the nascent expand-on-site chip. In addition, the converter may add bonding media or bonding features at appropriate places.

In the preferred embodiment shown in FIGS. 5 and 6, chip 105A comprises a single circular wall section 113 which is rolled to form a chip with a circular cross-section. In this embodiment the spines lock together primarily on themselves and the voids created by the spines. However, it is also possible to add apertures or holes in this embodiment as well. Partial jagged lines, such as 120 and 130, are formed on the wall section 113 at various intervals. There may be any number of fold lines 120 and 130, which are made by the converter with sufficient penetration of the chipboard to facilitate rolling of the wall section 113 during expansion by the expanding machine. On the other hand, the use of too numerous fold lines will weaken the integrity of the expanded chips and detract from their performance as packaging material. Upon rolling of the wall section 113 into a circular shape, spines 141 are exposed from partial jagged lines 120 and 130. The spines protrude outward from the wall section 113, but the wall section remains attached at common shoulders 121 and 131.

In addition, a fold line 110 is formed on one portion of wall section 113 to form a tab 111 between edge 115 and the wall section. Bonding media 117 can be applied to the tab 111 and/or to the mating bonding area 119 for securing the expanded chip in its final shape, shown in FIG. 5.

As shown in FIG. 6, the converter adds a perforation line 108X between chips 105 (A, B) and 106 (A, B) to enable them to be completely separated from one another prior to, during or after the expansion step, as necessary. The separation between chips 105B and 106B is accomplished, for example, by bursting shoulders 122. A similar line 108W can be added to the front of chips 105A and 105B, which as shown are the leading chips on the sheet 102. Similarly, a perforation line 108Y is formed between chips 106 (A, B) and 107 (A, B). Again, the separation between chips 106B and 107B can be accomplished by bursting shoulders 132. As illustrated in the drawing, lines 108W, 108X, 108Y and 108Z are zigzag in configuration, so that the edges formed on the separated and expanded chips will be jagged or serrated, thereby providing appropriate surfaces for interlocking with other fully expanded chips when used as packaging. The lines 108W, 108X, 108Y and 108Z could be formed in other configurations that would accomplish the same result.

Similarly, the intermediate converter forms a line of weakness 116 between the chips in row A (i.e., chips 105A, 106A and 107A) and the chips in row B (i.e., chips 105B, 106B and 107B). The chips in each row may be separated from the adjacent chip in the other by bursting line of weakness 116. Again, line 116 has a zigzag configuration, so that the edge of each chip after separation will be jagged or serrated to aid in interlocking of the expanded chips.

As noted previously, the intermediate converter may also adds apertures or holes at various locations on each chip formed on the chipboard. Usually, it is desirable to both cut the hole and to remove the center portion before shipment to the packager to reduce weight. Alternatively, the holes could be preformed by the converter, and the center portion removed or just folded in during expansion-on-site by the expanding machine. The holes may be any shape, e.g., circular, triangular, square or star shaped in configuration. There may be multiple holes in each section to decrease weight and increase interlocking. As described later, the holes interlock with jagged or serrated portions on adjacent chips after the chips are applied around a packaged item to be shipped thereby providing improved blocking, bracing and cushioning characteristics during shipment.

The bonding media 117 may be any suitable adhesive as described previously with respect to the triangular shaped chip. When the wall section 113 is rolled up to form the expanded chip, the ends thereof can be secured using a butt or tab joint as shown in FIG. 5A or a lap joint as shown in FIG. 5B. Obviously, adhesive is applied to the front or back of the tabs as appropriate to secure the chip in its final form.

As discussed previously, other securing means may be employed including connecting features and attachment methods.

We claim:

1. A packing chip formed from a flat intermediate sheet containing two or more precursors, said chip comprising:

sides configured so that the packing chip has a triangular cross-section;

securing means for securing the sides of the chip in a final shape; and one or more apertures on at least one side configured such that the packing chip forms interlocking engagement with portions of adjacent packing chips when employed as packaging.

2. The packing chip of claim 1 wherein one or more sides are configured to form serrated edges or spines on the packing chip for interlocking engagement with apertures of adjacent packing chips when employed as packaging.

3. The packing chip of claim 1 wherein the sheet is made of chipboard.

4. The packing chip of claim 1 wherein the securing means comprises bonding media.

5. The packing chip of claim 4 Wherein the bonding media is an adhesive selected from the group consisting of thermosetting, microwave-activated, ultrasonic-activated, wettable or pressure activated adhesive.

6. The packing chip of claim 1 wherein the securing means comprises connecting features.

7. The intermediate sheet of claim 6 wherein the connecting features are selected from the group consisting of dovetail slots and grooves, tongue and groove cuts, hook cuts and combinations thereof.

8. An intermediate sheet of two or more packing chip precursors, each chip precursor being separably connected to at least one adjacent chip precursor and the precursor further comprising:

three sections each of which is foldably attached to at least one other section which sections upon folding each form a side of the packing chip; and securing means for securing the sides of the packing chip in a completed shape selected from the group consisting of bonding media or connecting features, said shape having a triangular cross-section; and wherein the chip precursor contains one or more apertures on at least one section configured such that the expanded packing chip forms interlocking engagement with portions of adjacent packing chips when employed as packaging.

9. The intermediate sheet of claim 8 wherein the chip precursor contains one or more sides configured to form serrated edges or spines on the expanded packing for interlocking engagement with apertures of adjacent packing chips when employed as packaging.

10. The intermediate sheet of claim 8 wherein the sheet is made of chipboard.

11. The intermediate sheet of claim 8 wherein the securing means comprises bonding media.

12. The intermediate sheet of claim 11 wherein the bonding media is an adhesive selected from the group consisting of thermosetting, microwave-activated, ultrasonic-activated, wettable or pressure activated adhesive.

13. The intermediate sheet of claim 8 wherein the securing means comprises connecting features.

14. The intermediate sheet of claim 13 wherein the connecting features are selected from the group consisting of dovetail slots and grooves, tongue and groove cuts, hook cuts and combinations thereof.

15. The intermediate sheet of claim 8 wherein the sheet is rolled.

16. The intermediate sheet of claim 8 wherein the sheet is fan folded.

17. A method for forming an intermediate sheet of two or more packing chip precursors comprising:

forming lines of separation to separably connect each chip precursor to the adjacent chip precursors on said intermediate sheet;

forming three sections on each chip precursor by creating fold lines between adjacent sections, said sections each forming a side of the packing chip when expanded from the chip precursors;

adding one or more securing means for securing the sides of the packing chip in a final form when expanded selected from the group consisting of bonding media and connecting features, said form having a triangular cross-section; and adding one or more apertures on at least one section of the packing chip precursor, said aperture being configured such that the expanded packing chip forms interlocking engagement with portions of adjacent packing chips when employed as packaging.

18. The method of claim 17 which further includes the step of configuring one or more sides on the sections to form serrated edges or spines on the expanded packing chip for interlocking engagement with one or more apertures of adjacent packing chips when employed as packaging.

19. The method of claim 17 in which the intermediate sheet is made of chipboard.

20. The method of claim 17 in which the securing means comprises bonding media.

21. The method of claim 20 wherein the bonding media is an adhesive selected from the group consisting of thermosetting, microwave-activated, ultrasonic-activated, wettable or pressure activated adhesive.

22. The method of claim 17 in which the securing means comprises connecting features.

23. The method of claim 22 wherein the connecting features are selected from the group consisting of dovetail slots and grooves, tongue and groove cuts, hook cuts and combinations thereof.

24. The method of claim 17 further comprising forming the sheet into a roll.

25. The method of claim 17 further comprising fan folding of the sheet.

26. A method for forming an expand-on-site packing chip from an intermediate sheet containing two or more chip precursors comprising:

folding the precursor into three sections each of which forms a side of the expanded packing chip, said chip having a triangular cross-section;

attaching the sides of the expanded packing chip; and separating the expanded chip from the adjacent chip or chips.

27. The method of claim 26 in which the separating occurs prior to the folding.

28. The method of claim 26 in which the attaching is accomplished at least in part with connecting features.

29. The method of claim 28 wherein the connecting features are selected from the group consisting of dovetail slots and grooves, tongue and groove cuts, hook cuts and combinations thereof.

30. The method of claim 26 in which the attaching is accomplished with at least in part with bonding media.

31. The packing chip of claim 27 wherein the bonding media is an adhesive selected from the group consisting of thermosetting, microwave-activated, ultrasonic-activated, wettable or pressure activated adhesive.

32. A one-piece packing chip having an essentially triangular cross-section formed by three sides wherein:

at least one side contains one or more apertures at least one side contains a serrated edge or spine for engagement with serrated edges or apertures on adjacent packing chips when employed as packaging, and securing means for securing sides of the expanded packing chip.

33. The packing chip of claim 32 in which the chip is made of chipboard.

34. The packing chip of claim 33 wherein the securing means comprises bonding media.

35. The packing chip of claim 34 wherein the bonding media is an adhesive selected from the group consisting of thermosetting, microwave-activated, ultrasonic-activated, wettable or pressure activated adhesive.

36. The packing chip of claim 35 wherein the bonding media is a thermosetting adhesive.

37. The packing chip of claim 32 wherein the securing means comprises connecting features.

38. The method of claim 37 wherein the bonding media is an adhesive selected from the group consisting of thermosetting, microwave-activated, ultrasonic-activated, wettable or pressure activated adhesive.

* * * * *